US005292041A

United States Patent [19]

Yao

[11] Patent Number: 5,292,041

[45] Date of Patent: Mar. 8, 1994

[54] ADJUSTABLE ELASTIC BAND INSPECTING APPARATUS

[75] Inventor: Shin-Chuan Yao, Taipei, Taiwan

[73] Assignee: China Textile T & R Institute, Taipei, Taiwan

[21] Appl. No.: 65,768

[22] Filed: May 25, 1993

[51] Int. Cl.[5] ..... D06C 15/00; B25B 1/00

[52] U.S. Cl. ..... 223/63; 223/61; 223/52; 269/61; 269/63; 269/52; 269/72

[58] Field of Search ..... 223/61, 63, 52, 72; 38/102.1, 102.2, 102.91; 269/61, 63, 52, 72

[56] References Cited

U.S. PATENT DOCUMENTS 2,418,083 3/1947 Mayer ..... 223/63
2,529,708 11/1950 Schussel ..... 223/63
2,941,796 6/1960 Beyer ..... 269/76
3,495,747 2/1970 Saltiel ..... 223/72
4,531,720 7/1985 Söder ..... 269/76

*Primary Examiner*—Clifford D. Crowder
*Assistant Examiner*—Bibhu Mohanty
*Attorney, Agent, or Firm*—Morton J. Rosenberg; David I. Klein

[57] ABSTRACT

An adjustable elastic band inspecting apparatus comprising a supporting frame attached to a bench by a C-clamp, and an inspection holder connected to the support frame by a pivoting axle that enables the height and inclination of the inspection holder to be adjusted. The inspection holder further contains adjustable brackets symmetrically disposed and adaptable for elastic bands of various sizes. The brackets can be rotated by manipulating a locating bar to facilitate the inspection of two sides of elastic bands.

1 Claim, 5 Drawing Sheets

ADJUSTABLE ELASTIC BAND INSPECTING APPARATUS

BACKGROUND OF THE INVENTION

A familiar way to examine elastic bands executed in clothing factories relies on the workmen inserting their hands into the elastic band portions of clothing, such as jacket hems and elasticized waists, and stretching outwards. Operators straighten the wrinkled portions and examine the possible defects by eyes, which is rather tedious. Moreover, after one side of elastic bands is finished, the foregoing actions must be repeated for another examination to the other side. Such an operation is inconvenient and time-wasting. Besides, when a defect is detected, the operator must stretch the elastic band by one hand and trim clothing by the other hand, easily resulting in injuring clothes. Therefore, the conventional method brings much inconvenience to the clothing production.

OBJECT OF THE INVENTION

The primary object of the invention is to provide an elastic band inspecting apparatus that has two brackets with an adjustable span therebetween which brackets enable inspectors to mount elastic bands over the supporting abutments of the brackets to stretch the elastic bands for sewing defect inspection.

The other object of the invention is to provide a convenient elastic band inspecting apparatus having an adjustable structure that enables the heights and inclinations of the inspection holder and the supporting frame to be changed to adapt for operators having various frames, promoting their productivity.

BRIEF DESCRIPTION OF THE DRAWINGS

The invention will be described in more detail with reference to the drawings in which.

DETAILED DESCRIPTION

Figure 1:
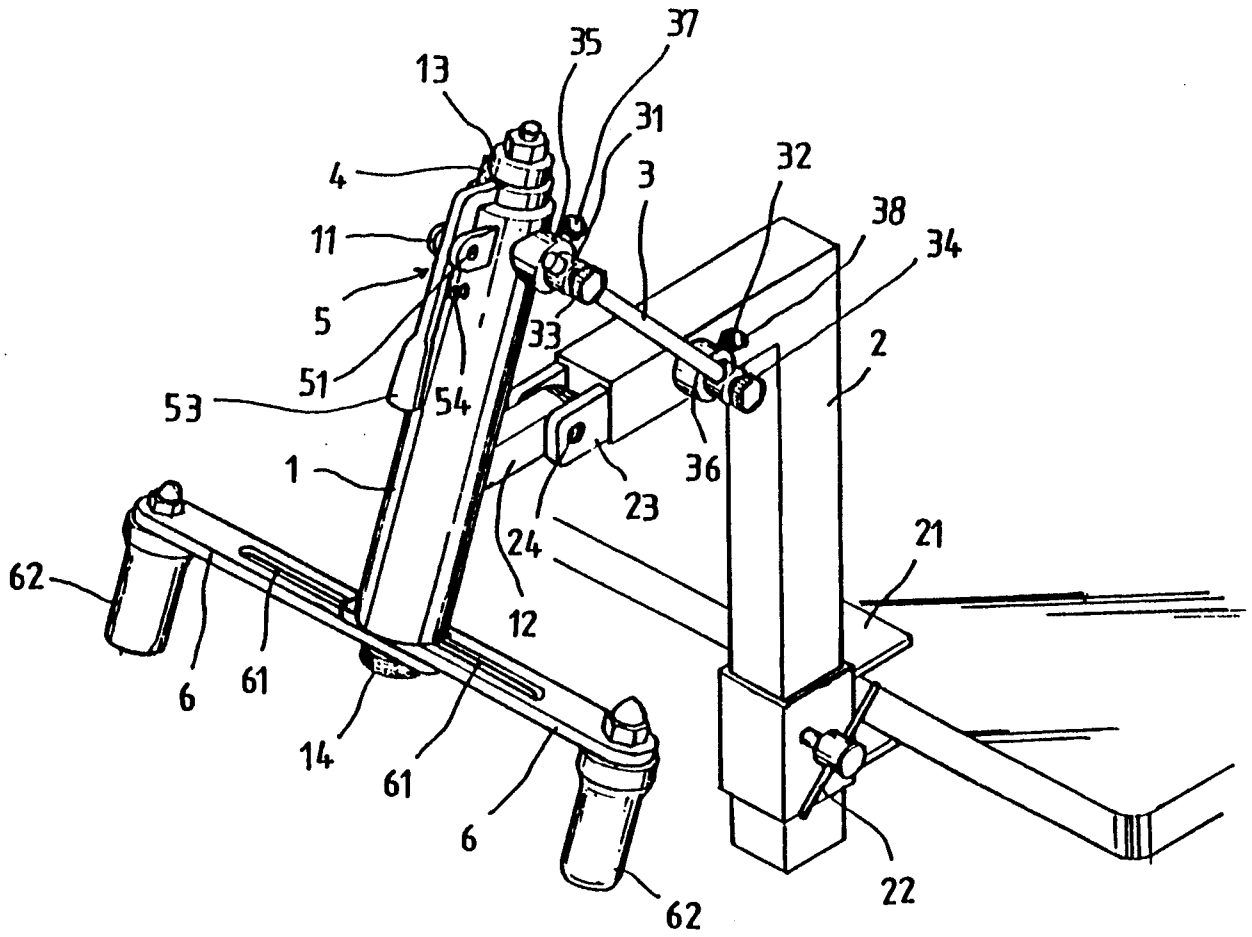
FIG. 1 is a perspective view of the invention.
Figure 2:
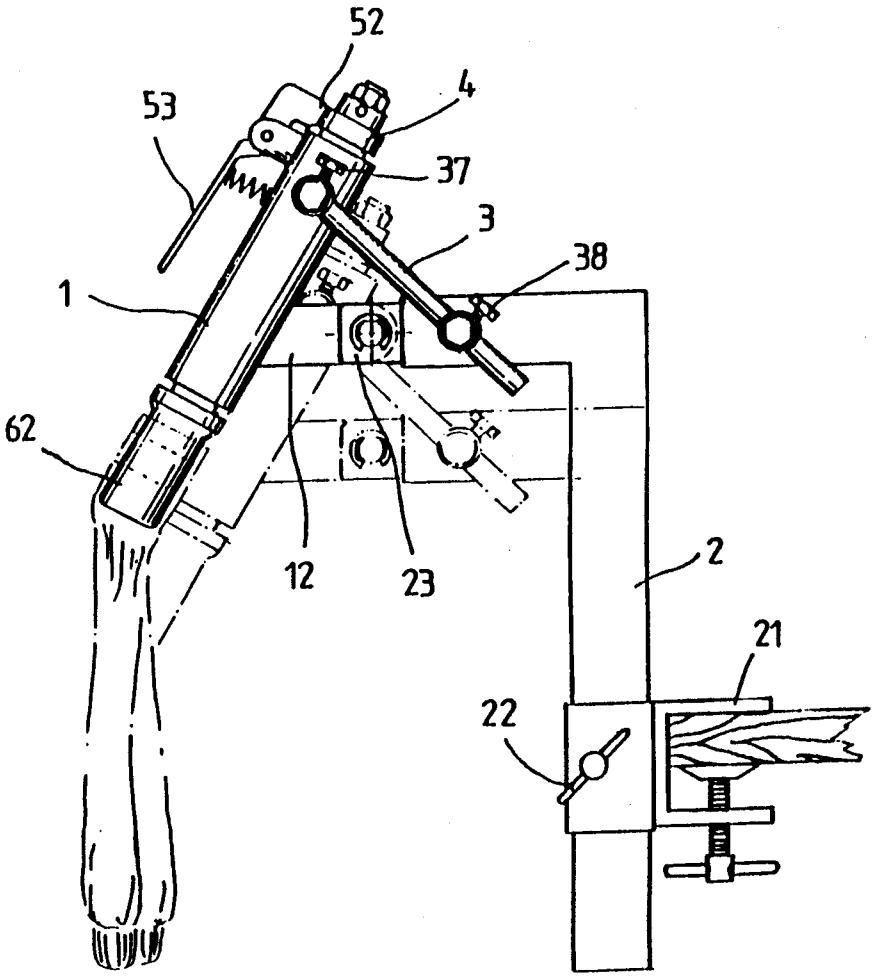
FIG. 2 is a schematic view showing the inspection holder and the supporting frame of the invention.
Figure 3:
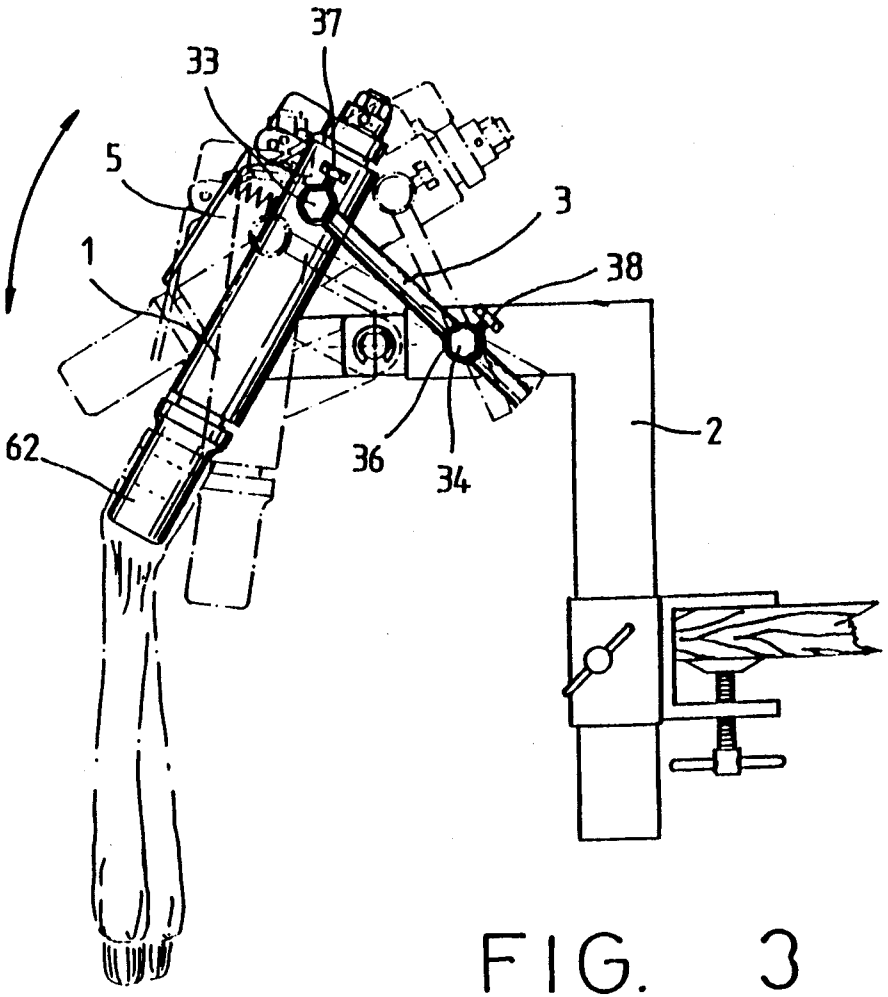
FIG. 3 is a schematic view illustrating the adjustment of the inclination of the inspection holder.
Figure 4:
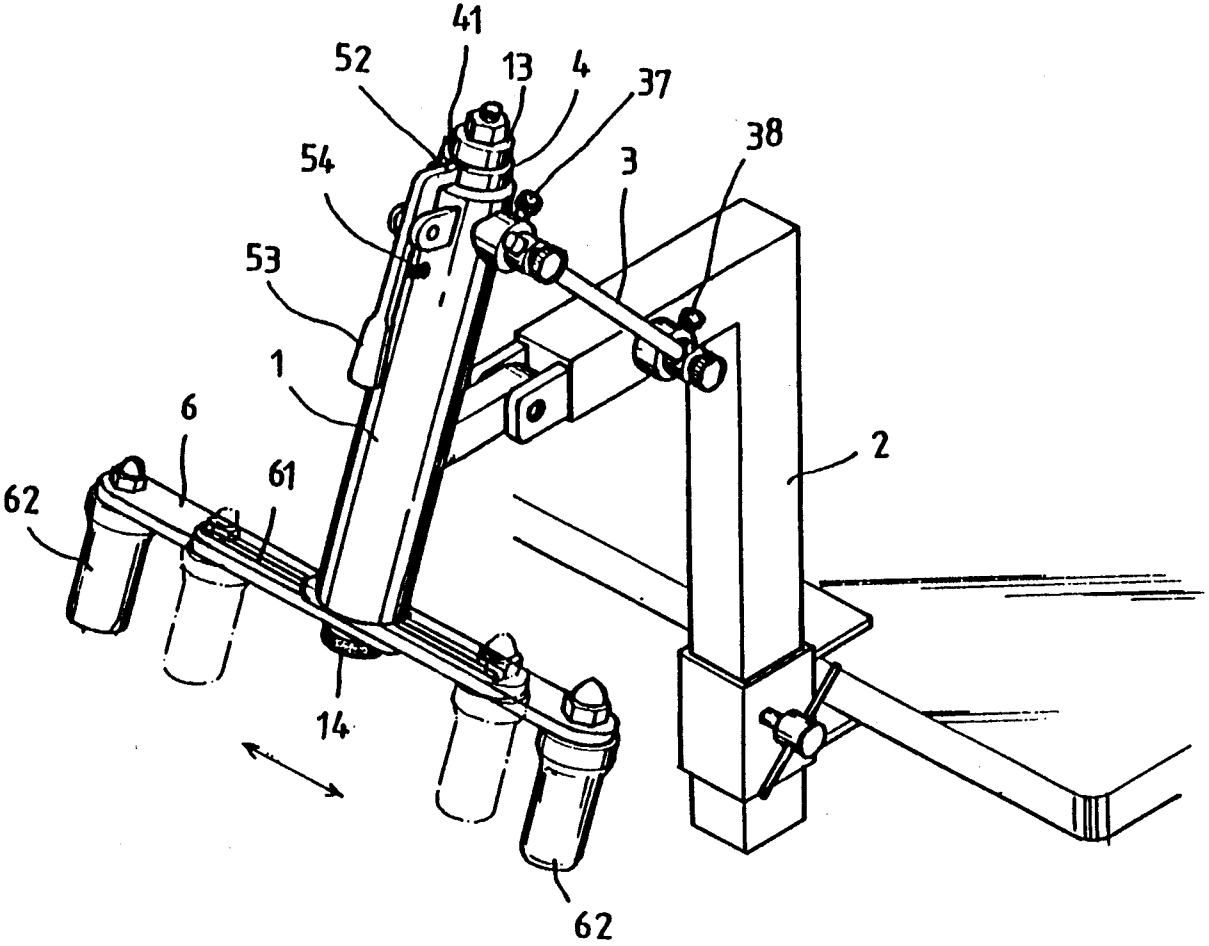
FIG. 4 shows the adjustment of the support abutment of the inspection holder.

FIGS. 1 and 2 show the assembly of the adjustable elastic band inspecting apparatus according to the invention, mainly comprising a supporting frame (2) and an inspection holder (1), in which the supporting frame (2) is attached to a bench by a C-clamp (21). Tightening and loosening the adjusting rod (22) of the C-clamp (21) may change the height of the inspecting apparatus, as shown in FIG. 2. On the top of the supporting frame (2) is a connecting portion (23) that pivotally supports one end of the support arm (12) of the inspection holder (1) by a pin (24). In addition, between the supporting frame (2) and the inspection holder (1) is a positioning rod (3) equipped with two axle tubes (31), (32) in conjunction with two knobs (33) and (34), each axle tube paired with a knob being respectively mounted on the axle bushes (35), (36) of the supporting frame (2) and the inspection holder (1). These two axle bushes are furnished with knobs (37), (38) respectively by which axle tubes (31), (32) and axle bushes (35), (36) can be set. Therefore, with the arrangement of a positioning rod (3), the inclination of the inspection holder (1) relative to the supporting frame (1) can be changed by rotating the inspection holder around the pin (24), as shown in FIG. 4.

Figure 5A:
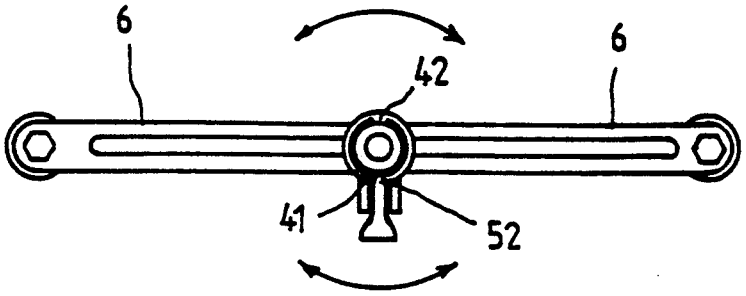
FIG. 5A is a top view showing the rotation and adjustment of the inspection holder.
Figure 5:
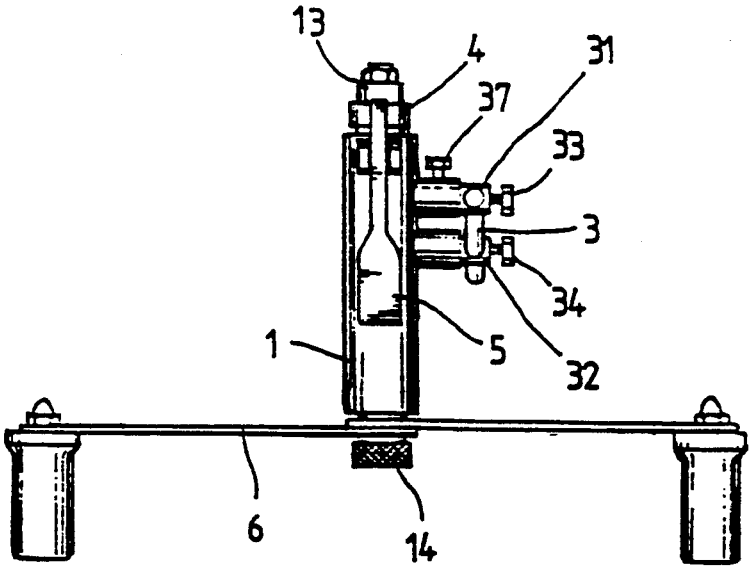
FIG. 5 is a front view of the inspection holder.

A locating ring (4) provided on the upper end of the inspection holder (1) is designed to have two engaging areas (41), (42) symmetrically disposed in 180 degrees apart. A locating bar (5) of which one end is a hook portion engageable with the engaging areas (41), (42) and the other end is a lever (53) under which is a spring (54) providing a constant resilient force to keep the hook portion being pressed down is pivotally supported by a pin (51) disposed on the lugs (11) of the inspection holder (1). Two brackets (6) are attached by a bolt (14) to the lower end of the inner axle (13) of the inspection holder (1). These two brackets (6) each with an elongated hole (61) provided thereon and a support abutment (62) disposed at the outer ends is designed to have a contour symmetrical to each other. As can be seen from FIG. 4, the inner axle (13) of the inspection holder (1) passes through the elongated holes of the brackets fastened thereon by a bolt (14) at the outermost end of the inner axle. Loosening the bolt allows the operator to adjust the positions of brackets for elastic bands of various sizes. When the span between the support abutments of the brackets (6) is set, tighten the bolt (14) to fix the brackets. To turn brackets (6), press the lever (53) at first, disengaging the hook portion (52) with the engaging areas (41) of the locating ring (4), and then rotate the brackets (6) as shown in FIG. 5A. When the brackets (6) rotate 180 degrees, the hook portion (52) of the locating bar (5) biased by the spring (54) will automatically engage with the other engaging area (42) of the locating ring (4). Therefore, it can obtain an index effect, controlling the brackets revolving 180 degrees each time.

With this arrangement, the inspecting apparatus is operated as follows.

The operator first adjusts the supporting frame (2) to a decent height and sets the positioning rod (3) so as to place the inspection holder at a position adaptable to the operator, after which clothes to be examined or trimmed are put on the support abutments (62) of the brackets (6) of the inspection holder (1) between which the span may be adjusted to fit for elastic bands of various sizes. As one side of the elastic band is finished, slightly pressing down the lever (53) will make the brackets (6) turn 180 degrees for the examination of the other side. And so it can obtain a maximum convenience for inspection or trimming.

What is claimed is:

1. An adjustable elastic band inspecting apparatus comprising a supporting frame, an inspection holder, and a positioning rod; in which said supporting frame includes a C-clamp having an adjusting rod which enables the height of said supporting frame to be adjusted by loosening and tightening the adjusting rod of the C-clamp, and on the top of said supporting frame is a connecting portion to which said inspection holder is pivotally jointed by a pin; said inspection holder being is equipped with a rotatable inner axle on the upper end of which is arranged a locating ring with two symmetric engaging areas, and further having a locating bar of which one end is a hook portion engageable with the engaging areas of the locating ring and the other end is a lever under which is arranged a spring providing a constant resilient force to keep the hook portion pressed down against the engaging areas, said lever is pivotally connected to the inspection holder by a pin, the apparatus further including two brackets, shaped symmetric to each other and each having an elongated hole and an adjustable support abutment disposed at the outer end of each bracket thereof, and the brackets being attached to the lower end of the inner axle which passes through the elongated hole with a bolt fastened on the outermost end thereof; and said positioning rod being equipped with two pair of axle tubes and knobs, respectively mounted on axle bushes mounted to said supporting frame and said inspection holder.

* * * * *